US007481067B2

(12) United States Patent
Nakayama et al.

(10) Patent No.: US 7,481,067 B2
(45) Date of Patent: Jan. 27, 2009

(54) FREEZER

(75) Inventors: Hiroshi Nakayama, Shiga (JP); Shinichi Sakamoto, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 587 days.

(21) Appl. No.: 10/492,369

(22) PCT Filed: Oct. 25, 2002

(86) PCT No.: PCT/JP02/11122

§ 371 (c)(1),
(2), (4) Date: Apr. 12, 2004

(87) PCT Pub. No.: WO03/042605

PCT Pub. Date: May 22, 2003

(65) Prior Publication Data

US 2004/0244394 A1 Dec. 9, 2004

(30) Foreign Application Priority Data

Nov. 13, 2001 (JP) ..... 2001-347050

(51) Int. Cl.
*F25B 41/04* (2006.01)
*F25B 39/04* (2006.01)

(52) U.S. Cl. ..... 62/222; 62/509

(58) Field of Classification Search ..... 62/222, 62/223, 224, 225, 210, 211, 509
See application file for complete search history.

(56) References Cited

U.S. PATENT DOCUMENTS 2,954,681 A * 10/1960 McCormack ..... 62/196.4
5,752,391 A 5/1998 Ozaki et al.

FOREIGN PATENT DOCUMENTS

| | | | |
|---|---|---|---|
| AU | 2504195 | A1 | 2/1996 |
| EP | 1059495 | A2 | 12/2000 |
| JP | 7-294044 | A | 11/1995 |
| JP | 10-160268 | A | 6/1998 |
| JP | 10-300244 | A | 11/1998 |
| JP | 10-318613 | A | 12/1998 |
| JP | 11-63694 | A | 3/1999 |

(Continued)

OTHER PUBLICATIONS

M.G. Yarrall et al., "Performance of a Transcritical $CO_2$ Heat Pump for Simultaneous Refrigeration and Water Heating," 20th International Conference of Refrigeration, IIR/IIF, Sydney, Sep. 19, 1999, vol. III (Paper 651).

*Primary Examiner*—Marc E Norman
(74) *Attorney, Agent, or Firm*—Birch, Stewart, Kolasch & Birch, LLP

(57) ABSTRACT

A refrigerant circuit R includes, a compressor 25 for compressing a refrigerant to a pressure higher than the critical pressure, a gas cooler 26, a motor-operated expansion valve 27, and an evaporator 28, and uses as a refrigerant a natural system refrigerant. A receiver 43 is provided to the high-pressure side of the refrigerant circuit R. There is provided an adjusting valve 44 for adjusting the refrigerant amount flowing through the inside of the receiver 43. A controller 55 adjusts the opening of the adjusting valve 44 so as to bring the temperature of the receiver 43 close to a target receiver temperature.

15 Claims, 6 Drawing Sheets

FOREIGN PATENT DOCUMENTS

| | | | |
|---|---|---|---|
| JP | 11-201560 | A | 7/1999 |
| JP | 2000-146328 | A | 5/2000 |
| JP | 2000-179958 | A | 6/2000 |
| JP | 2000-266415 | A | 9/2000 |
| JP | 2001-133058 | A | 5/2001 |
| JP | 2001-141316 | A | 5/2001 |
| JP | 2001-255028 | A | 9/2001 |
| JP | 2002-228282 | A | 8/2002 |
| JP | 2002-277078 | A | 9/2002 |
| WO | WO 90/07683 | A1 | 7/1990 |

* cited by examiner

FREEZER

TECHNICAL FIELD

The present invention relates to a refrigerating apparatus having supercritical refrigerating cycles using as a refrigerant a natural system refrigerant, which apparatus is suitable to be used for, for example, a heat-source unit of heat pump type hot-water supply equipment.

BACKGROUND ART

Heat pump type hot-water supply equipment is equipped with, in general, a tank unit 71 having a hot-water reservoir tank 70, and a heat-source unit 73 having a refrigerant circuit 72, as shown in FIG. 7. The refrigerant circuit 72 is so configured as to connect a compressor 74, a hydrothermal exchanger 75, an expansion valve 77, and an evaporator 78 in order. The tank unit 71 includes the hot-water reservoir tank 70 and a circulation path 79. The circulation path 79 is provided with a pump 80 for water circulation and a heat exchange path 81 which constitutes a part of the hydrothermal exchanger 75.

Here, the operation of the aforementioned heat pump type hot-water supply equipment will be described.

First, the compressor 74 is driven while the pump 80 for water circulation is also driven (operated). Then, stored water (hot water) flows out from the water intake provided at the bottom of the hot-water reservoir tank 70 to the circulation path 79, and the hot-water flown out flows through the heat exchange path 81. Here, the hot water flowing through the heat exchange path 81 is heated (boiled) by the hydrothermal exchanger 75. The hot water heated flows into the top portion of the hot-water reservoir tank 70 from the hot-water inlet. Thereby, the hot water of high temperature is stored in the hot-water reservoir tank 70.

Conventionally, as a refrigerant circulating the refrigerant circuit, such a refrigerant as dichlorodifluoromethane (R-12) or chlorodifluoromethane (R-22) was used. However, from the point of preventing destruction of the ozone layer, preventing environmental pollution, and the like, an alternative refrigerant such as 1,1,1,2-tetrafluoro ethane (R-134a) has been used as a refrigerant. Still, the alternative refrigerant such as R-134a has a problem of having a high ability to cause a greenhouse effect or the like. Therefore, it has been gradually recommended in recent years to use a natural system refrigerant, which is free of the aforementioned defect, as a refrigerant. As a natural system refrigerant of this kind, carbon dioxide, for example, is well known.

As the outside air temperature varies along with the season's transition, a load change occurs in the aforementioned equipment. According to the load change, the refrigerant cycles also change. This means that the preferable amount of circulated refrigerant is different for every season. Thus, it has been difficult to operate with the optimum amount of circulated refrigerant unless some measures are taken. If the actual amount of the circulated refrigerant is less than the optimum amount of the circulated refrigerant, the superheated refrigerant is sucked into the compressor 74, causing the compressor 74 to be operated in the excessively superheated condition. In contrast, if the actual amount of the circulated refrigerant exceeds the optimum amount of the circulated refrigerant, the refrigerant, which has not been evaporated completely, is sucked into the compressor 74, causing the compressor 74 to be operated in the wet condition. As a result, the reliability of the compressor 74 is degraded.

The present invention is developed to solve the aforementioned conventional problems. The object of the present invention is to provide a technique which enables to operate with a proper amount of circulated refrigerant by controlling the amount, and prevents an excessive superheat operation or a wet operation.

DISCLOSURE OF THE INVENTION

A first refrigerating apparatus devised by the present invention comprises: a supercritical freezing cycle R having a compressor 25 for compressing a refrigerant to a pressure higher than the critical pressure, a gas cooler 26, a motor-operated expansion valve 27 and an evaporator 28, and using as the refrigerant a natural system refrigerant; a receiver 43 provided to the high-pressure side of the supercritical freezing cycle R; a receiver temperature detector 50*a* for detecting the temperature of the receiver 43; and a controller 55 for controlling the amount of the circulated refrigerant by bringing the temperature of the receiver 43 detected by the receiver temperature detector 50*a* close to a target receiver temperature.

In the aforementioned first refrigerating apparatus, the controller 55 controls the temperature of the receiver 43 so as to come close to the target receiver temperature set corresponding to, for example, the season, whereby the refrigerant temperature in the receiver 43 can be adjusted. This enables to control the density of the refrigerant in the receiver 43. As a result, the refrigerant amount stored in the receiver 43 can be adjusted. Therefore, the refrigerant amount stored in the receiver 43 can be made to the amount corresponding to the season, whereby the amount of the circulated refrigerant can be made to the amount corresponding to the season. Therefore, an excessive superheat operation and a wet operation can be prevented.

A second refrigerating apparatus devised by the present invention comprises an outside air temperature detector 53*a* for detecting the outside air temperature, and the controller 55 thereof is so configured as to calculate the target receiver temperature based on the outside air temperature detected by the outside air temperature detector 53*a*.

In the aforementioned second refrigerating apparatus, the controller 55 calculates the target receiver temperature based on the outside air temperature serving as an index for controlling the amount of the circulated refrigerant. Therefore, it is ensured that the amount of the circulated refrigerant is made to the expected amount (for example, the amount of the circulated refrigerant corresponding to the season).

Further, since the outside air temperature is detected by the outside air temperature detector 53*a*, the outside air temperature can be detected without a computation. Therefore, if the target receiver temperature is calculated based on the outside air temperature, it is possible to simplify the computation for controlling the amount of the circulated refrigerant.

A third refrigerating apparatus devised by the present invention comprises an air heat exchange thermistor 51*a* and a suction pipe thermistor 52*a* for detecting the superheat degree of the refrigerant at the outlet of the evaporator 28, and the controller 55 thereof is so configured as to calculate the target receiver temperature based on the superheat degree detected by the air heat exchange thermistor 51*a* and the suction pipe thermistor 52*a*.

In the third refrigerating apparatus, the controller 55 calculates the target receiver temperature based on the superheat degree serving as an index for controlling the amount of the circulated refrigerant. Therefore, it is ensured that the amount of the circulated refrigerant is made to the expected amount (for example, the amount of the circulated refrigerant corresponding to the season).

Further, the magnitude of the superheat degree has a close relationship with the degree of the superheat operation. Therefore, if the target receiver temperature is calculated based on the superheat degree, it is possible to control the amount of the circulated refrigerant with high precision.

A forth refrigerating apparatus devised by the present invention comprises, an outside air temperature detector 53*a* for detecting the outside air temperature, and an air heat exchange thermistor 51*a* and a suction pipe thermistor 52*a* for detecting the superheat degree of the refrigerant at the outlet of the evaporator 28, and the controller 55 thereof is so configured as to calculate the target receiver temperature based on the outside air temperature detected by the outside air temperature detector 53*a* and the superheat degree detected by the air heat exchange thermistor 51*a* and the suction pipe thermistor 52*a*. In the aforementioned forth refrigerating apparatus, the controller 55 calculates the target receiver temperature based on the outside air temperature and the superheat degree serving as indexes for controlling the amount of the circulated refrigerant. Therefore, it is ensured that the amount of the circulated refrigerant is made to the expected amount (for example, the amount of the circulated refrigerant corresponding to the season).

Further, if the target receiver temperature is calculated based on the outside air temperature and the superheat degree, the target receiver temperature is calculated based on the two indexes, whereby it is possible to control the amount of the circulated refrigerant with high precision.

A fifth refrigerating apparatus devised by the present invention comprises an adjusting valve 44 for adjusting the amount of the refrigerant flowing through the inside of the receiver 43, and the controller 55 thereof is so configured as to adjust the opening of the adjusting valve 44 to thereby bring the temperature of the receiver 43 detected by the receiver temperature detector 50*a* close to the target receiver temperature.

In the aforementioned fifth refrigerating apparatus, the controller 55 brings the temperature of the receiver 43 close to the target receiver temperature by adjusting the opening of the adjusting valve 44. Therefore, with a simple control of adjusting the opening of the adjusting valve 44, the amount of the circulated refrigerant can be controlled.

A sixth refrigerating apparatus devised by the present invention comprises: a supercritical freezing cycle R having a compressor 25 for compressing a refrigerant to a pressure higher than the critical pressure, a gas cooler 26, a motor-operated expansion valve 27 and an evaporator 28, and using as the refrigerant a natural system refrigerant; a receiver 43 provided to the high-pressure side of the supercritical freezing cycle R; an adjusting valve 44 for adjusting the amount of the refrigerant flowing through the inside of the receiver 43; an outside air temperature detector 53*a* for detecting the outside air temperature; and a controller 55 for controlling the amount of the circulated refrigerant by adjusting the opening of the adjusting valve 44 based on the outside air temperature detected by the outside air temperature detector 53*a*.

In the aforementioned sixth refrigerating apparatus, the controller 55 adjusts the opening of the adjusting valve 44 based on the outside air temperature serving as an index for controlling the amount of the circulated refrigerant. Thereby, the refrigerant amount stored in the receiver 43 (refrigerant amount flowing through the inside of the receiver 43) can be adjusted. Therefore, the amount of the circulated refrigerant can be made to the expected amount, whereby an excessive superheat operation and a wet operation can be prevented.

Further, since the outside air temperature is detected by the outside air temperature detector 53*a*, the outside air temperature can be detected without a computation. Therefore, if the opening of the adjusting valve 44 is adjusted based on the outside air temperature, it is possible to simplify the computation for controlling the amount of the circulated refrigerant.

A seventh refrigerating apparatus devised by the present invention comprises: a supercritical freezing cycle R having a compressor 25 for compressing a refrigerant to a pressure higher than the critical pressure, a gas cooler 26, a motor-operated expansion valve 27 and an evaporator 28, and using as the refrigerant a natural system refrigerant; a receiver 43 provided to the high-pressure side of the supercritical freezing cycle R; an adjusting valve 44 for adjusting the amount of the refrigerant flowing through the inside of the receiver 43; an air heat exchange thermistor 51*a* and a suction pipe thermistor 52*a* for detecting the superheat degree of the refrigerant at the outlet of the evaporator 28; and a controller 55 for controlling the amount of the circulated refrigerant by adjusting the opening of the adjusting valve 44 based on the superheat degree detected by the air heat exchange thermistor 51*a* and the suction pipe thermistor 52*a*. In the aforementioned seventh refrigerating apparatus, the controller 55 adjusts the opening of the adjusting valve 44 based on the superheat degree serving as an index for controlling the amount of the circulated refrigerant. Thereby, the refrigerant amount stored in the receiver 43 (refrigerant amount flowing through the inside of the receiver 43) can be adjusted. Therefore, the amount of the circulated refrigerant can be made to the expected amount, whereby an excessive superheat operation and a wet operation can be prevented.

Further, the magnitude of the superheat degree has a close relationship with the degree of the superheat operation. Therefore, if the opening of the adjusting valve 44 is adjusted based on the superheat degree, the amount of the circulated refrigerant can be controlled with high precision.

An eighth refrigerating apparatus devised by the present invention comprises: a supercritical freezing cycle R having a compressor 25 for compressing a refrigerant to a pressure higher than the critical pressure, a gas cooler 26, a motor-operated expansion valve 27, and an evaporator 28, and using as the refrigerant a natural system refrigerant; a receiver 43 provided to the high-pressure side of the supercritical freezing cycle R; an adjusting valve 44 for adjusting the amount of the refrigerant flowing through the inside of the receiver 43; an outside air temperature detector 53*a* for detecting the outside air temperature; an air heat exchange thermistor 51*a* and a suction pipe thermistor 52*a* for detecting the superheat degree of the refrigerant at the outlet of the evaporator 28; and a controller 55 for controlling the amount of the circulated refrigerant by adjusting the opening of the adjusting valve 44 based on the outside air temperature detected by the outside air temperature detector 53*a* and the superheat degree detected by the air heat exchange thermistor 51*a* and the suction pipe thermistor 52*a*. In the aforementioned eighth refrigerating apparatus, the controller 55 adjusts the opening of the adjusting valve 44 based on the outside air temperature and the superheat degree serving as indexes for controlling the amount of the circulated refrigerant. Thereby, the refrigerant amount stored in the receiver 43 (refrigerant amount flowing through the inside of the receiver 43) can be adjusted. Therefore, the amount of the circulated refrigerant can be made to the expected amount, whereby an excessive superheat operation and a wet operation can be prevented.

Further, if the opening of the adjusting valve 44 is adjusted based on the outside air temperature and the superheat degree, the target receiver temperature is calculated based on the two indexes, whereby the amount of the circulated refrigerant can be controlled with high precision.

A ninth refrigerating apparatus devised by the present invention comprises, an adjusting valve 44 for adjusting the amount of the refrigerant flowing through the inside of the receiver 43, and an outside air temperature detector 53*a* detecting the outside air temperature, and the controller 55 thereof is so configured as to correct from time to time during operation the target receiver temperature based on the outside air temperature, and adjust from time to time during operation the opening of the adjusting valve 44, to thereby bring the temperature of the receiver 43 close to the target receiver temperature corrected.

In the aforementioned ninth refrigerating apparatus, the controller 55 corrects from time to time during operation the target receiver temperature based on the outside are temperature, and adjusts from time to time during operation the opening of the adjusting valve 44 corresponding to the target receiver temperature corrected. Thereby, it is ensured to bring the temperature of the receiver 43 close to the target receiver temperature corrected. Therefore, the refrigerant amount stored in the receiver 43 can be made to the amount corresponding to, for example, the season, and the amount of the circulated refrigerant can be made to the amount corresponding to the season, whereby an excessive superheat operation and a wet operation can be prevented.

A tenth refrigerating apparatus devised by the present invention comprises, an adjusting valve 44 for adjusting the amount of the refrigerant flowing through the inside of the receiver 43, and an air heat exchange thermistor 51*a* and a suction pipe thermistor 52*a* for detecting the superheat degree of the refrigerant at the outlet of the evaporator 28, and the controller 55 thereof is so configured as to correct from time to time during operation the target receiver temperature based on the superheat degree, and adjust from time to time during operation the opening of the adjusting valve 44, to thereby bring the temperature of the receiver 43 close to the target receiver temperature corrected.

In the aforementioned tenth refrigerating apparatus, the controller 55 corrects from time to time during operation the target receiver temperature based on the superheat degree, and adjusts from time to time during operation the opening of the adjusting valve 44 corresponding to the target receiver temperature corrected. Thereby, it is ensured to bring the temperature of the receiver 43 close to the target receiver temperature corrected. Therefore, the refrigerant amount stored in the receiver 43 can be made to the amount corresponding to, for example, the season, and the amount of the circulated refrigerant can be made to the amount corresponding to the season, whereby an excessive superheat operation and a wet operation can be prevented.

An eleventh refrigerating apparatus according to the present invention comprises: an adjusting valve 44 for adjusting the amount of the refrigerant flowing through the inside of the receiver 43; an outside air temperature detector 53*a* for detecting the outside air temperature; and an air heat exchange thermistor 51*a* and a suction pipe thermistor 52*a* for detecting the superheat degree of the refrigerant at the outlet of the evaporator 28; and the controller 55 thereof is so configured as to correct from time to time during operation the target receiver temperature based on the outside air temperature and the superheat degree, and adjust from time to time during operation the opening of the adjusting valve 44 to thereby bring the temperature of the receiver 43 close to the target receiver temperature corrected.

In the aforementioned eleventh refrigerating apparatus, the controller 55 corrects from time to time during operation the target receiver temperature based on the outside air temperature and the superheat degree, and adjusts from time to time during operation the opening of the adjusting valve 44 corresponding to the target receiver temperature corrected. Thereby, it is ensured to bring the temperature of the receiver 43 close to the target receiver temperature corrected. Therefore, the refrigerant amount stored in the receiver 43 can be made to the amount corresponding to, for example, the season, and the amount of the circulated refrigerant can be made to the amount corresponding to the season, whereby an excessive superheat operation and a wet operation can be prevented.

Each of a twelfth through a fifteenth refrigerating apparatuses devised by the present invention comprises, a bypass circuit 42 for connecting an intermediate portion of the high-pressure side of the supercritical freezing cycle R and a downstream portion located at the downstream side of the intermediate portion. The receiver 43 is provided to the bypass circuit 42, and the adjusting valve 44 is provided in between the receiver 43 and the downstream portion in the bypass circuit 42.

In each of the aforementioned twelfth through fifteenth refrigerating apparatuses, since the adjusting valve 44 is provided in between the receiver 43 and the downstream portion in the bypass circuit 42, the controller 55 can surely control the refrigerant amount stored in the receiver 43 provided to the bypass circuit 42, by adjusting the opening of the adjusting valve 44, whereby the amount of the circulated refrigerant can be surely made to the expected amount.

Each of a sixteenth through a nineteenth refrigerating apparatuses devised by the present invention comprises, a heat exchanger S for causing a heat exchange between the receiver 43 and the low-pressure refrigerant flowing through a passage 47 in the low-pressure side of the supercritical freezing cycle R.

In each of the aforementioned sixteenth through nineteenth refrigerating apparatuses, the receiver 43 (the high-pressure refrigerant in the receiver 43) and the low-pressure refrigerant flowing through the passage in the low-pressure side of the supercritical freezing cycle R perform a heat exchange by the heat exchanger S, whereby the receiver 43 (the high-pressure refrigerant) can be cooled by the low-pressure refrigerant. Therefore, it is possible to easily bring the temperature of the receiver 43 (the high-pressure refrigerant) close to the target receiver temperature using the low-pressure refrigerant, without any additional cooler.

EFFECTS

According to the aforementioned first refrigerating apparatus, the controller brings the receiver temperature close to the target receiver temperature, whereby the refrigerant amount stored in the receiver can be made to the amount corresponding to, for example, the season, whereby the amount of the circulated refrigerant can be made to the proper amount. Consequently, it is possible to operate the apparatus with the optimum amount of the circulated refrigerant through the year, whereby an excessive superheat operation and a wet operation can be prevented. This secures the reliability of the compressor. Further, by controlling the amount of the circulated refrigerant, a system such as heat pump type hot-water supply equipment having this refrigerating apparatus can exhibit maximum ability.

According to the aforementioned second refrigerating apparatus, the controller brings the receiver temperature close to the target receiver temperature, whereby it is ensured that the amount of the circulated refrigerant is made to the expected amount (the amount of the circulated refrigerant corresponding to the season), and also a stable operation can be made. Further, if the target receiver temperature is calculated based on the outside air temperature, the amount of the circulated refrigerant can be easily controlled.

According to the aforementioned third refrigerating apparatus, the controller brings the receiver temperature close to the target receiver temperature, whereby it is ensured that the amount of the circulated refrigerant is made to the expected amount (the amount of the circulated refrigerant corresponding to the season), and also a stable operation can be made. Further, if the target receiver temperature is calculated based on the superheat degree, the amount of the circulated refrigerant can be controlled with high precision.

According to the aforementioned forth refrigerating apparatus, the controller brings the receiver temperature close to the target receiver temperature, whereby it is ensured that the amount of the circulated refrigerant is made to the expected amount (the amount of the circulated refrigerant corresponding to the season), and also a stable operation can be made. Further, if the target receiver temperature is calculated based on the outside air temperature and the superheat degree, the amount of the circulated refrigerant can be controlled with higher precision.

According to the aforementioned fifth refrigerating apparatus, the controller brings the receiver temperature close to the target receiver temperature by adjusting the opening of the adjusting valve, whereby the amount of the circulated refrigerant can be easily controlled. Further, since the control for bringing the receiver temperature close to the target receiver temperature is such a simple control as adjusting the opening of the adjusting valve, the controller can be simplified. This leads to a reduction in the cost of the refrigerating apparatus.

According to the aforementioned sixth refrigerating apparatus, it is ensured that the mount of the circulated refrigerant can be made to the expected amount, whereby an excessive superheat operation and a wet operation can be prevented. This secures the reliability of the compressor. Further, by controlling the amount of the circulated refrigerant, a system such as heat pump type hot-water supply equipment having this refrigerating apparatus can exhibit maximum ability. Moreover, if the opening of the adjusting valve is adjusted based on the outside air temperature, it is possible to simplify the computation for controlling the amount of the circulated refrigerant.

According to the aforementioned seventh refrigerating apparatus, it is ensured that the mount of the circulated refrigerant can be made to the expected amount, whereby an excessive superheat operation and a wet operation can be prevented. This secures the reliability of the compressor. Further, by controlling the amount of the circulated refrigerant, a system such as heat pump type hot-water supply equipment having this refrigerating apparatus can exhibit maximum ability. Moreover, if the opening of the adjusting valve is adjusted based on the superheat degree, it is possible to control the amount of the circulated refrigerant with high precision.

According to the aforementioned eighth refrigerating apparatus, it is ensured that the mount of the circulated refrigerant can be made to the expected amount, whereby an excessive superheat operation and a wet operation can be prevented. This secures the reliability of the compressor. Further, by controlling the amount of the circulated refrigerant, a system such as heat pump type hot-water supply equipment having this refrigerating apparatus can exhibit maximum ability. Moreover, if the opening of the adjusting valve is adjusted based on the outside air temperature and the superheat degree, it is possible to control the amount of the circulated refrigerant with higher precision.

According to the ninth through eleventh refrigerating apparatuses described above, it is possible to surely bring the receiver temperature close to the target receiver temperature. Therefore, the refrigerant amount stored in the receiver can be made to the amount corresponding to the season, and the amount of the circulated refrigerant can be made to the proper amount. This can surely prevent an excessive superheat operation and a wet operation, and secure the reliability of the compressor. Further, by controlling the amount of the circulated refrigerant, a system such as heat pump type hot-water supply equipment having this refrigerating apparatus can exhibit maximum ability.

According to the twelfth through fifteenth refrigerating apparatuses described above, the controller adjusts the opening of the adjusting valve, whereby the refrigerant amount flowing through the inside of the receiver provided to the bypass circuit (the refrigerant amount stored in the receiver) can be surely controlled. Therefore, it is ensured that the amount of the circulated refrigerant corresponding to the season can be obtained, so that an excessive superheat operation and a wet operation can be prevented.

According to the sixteenth through nineteenth refrigerating apparatus described above, it is possible to easily bring the receiver temperature close to the target receiver temperature using the low-pressure refrigerant flowing through a passage in the low-pressure side of the supercritical freezing cycle, without any additional cooler. Therefore, it is ensured that the amount of the circulated refrigerant corresponding to the season can be obtained, so that an excessive superheat operation and a wet operation can be prevented. Further, the configuration of the refrigerating apparatus can be simplified since no additional cooler is required.

BEST MODE FOR CARRYING OUT THE INVENTION

Figure 1:
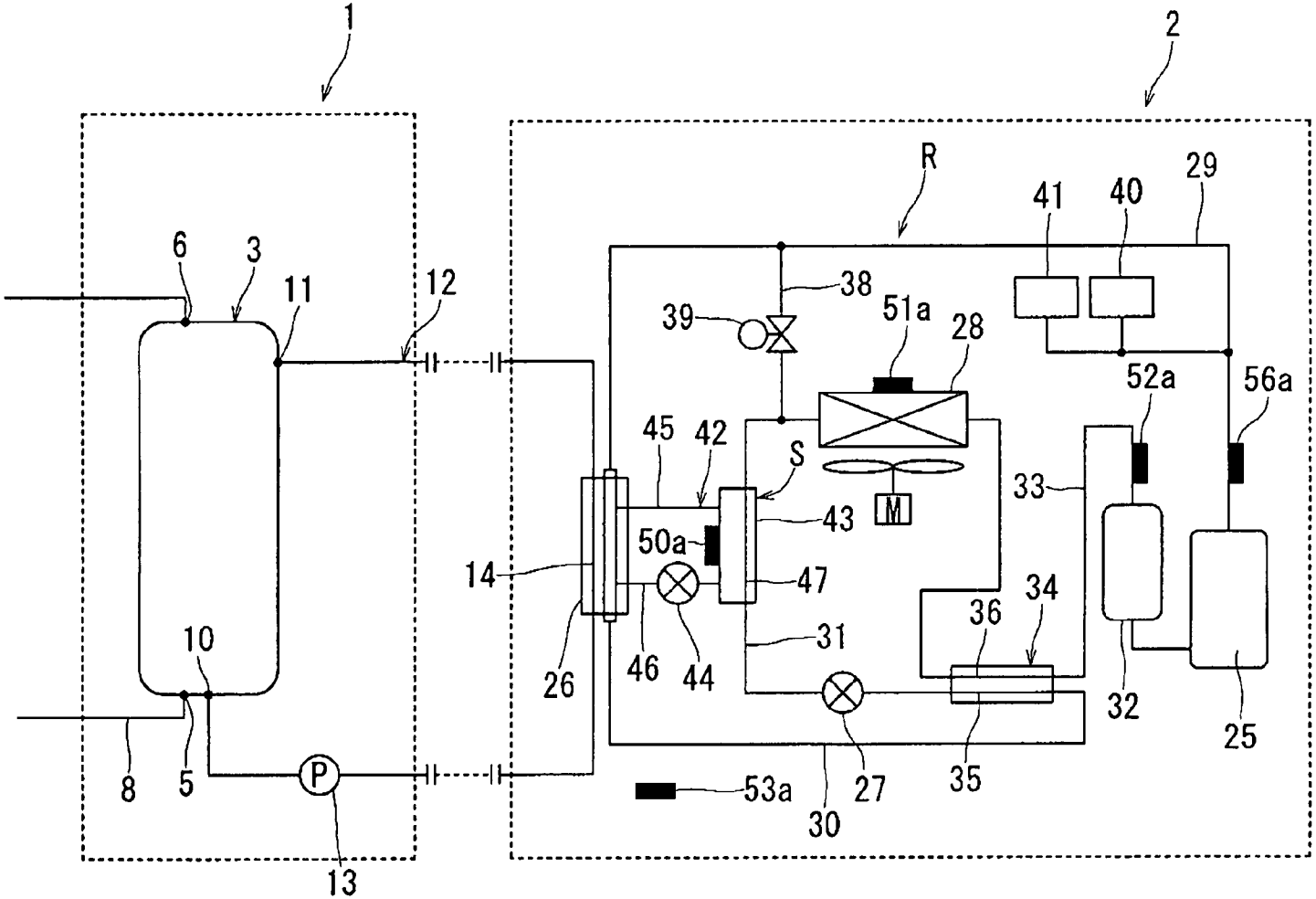
FIG. 1 is a schematic diagram showing heat pump type hot-water supply equipment according to an embodiment.

Next, a specific embodiment of a refrigerating apparatus according to the present invention will be explained in detail with reference to the drawings. FIG. 1 shows a schematic diagram of heat pump type hot-water supply equipment using a refrigerating apparatus according to the present invention.

This heat pump type hot-water supply equipment is equipped with a tank unit 1 and a heat source unit 2, and heats water (hot water) of the tank unit 1 by the heat source unit 2.

The tank unit 1 includes a hot-water reservoir tank 3, and the hot water stored in the hot-water reservoir tank 3 is supplied to, for example, a bath tub (not shown). Thus, in the hot-water reservoir tank 3, there are provided a water supply opening 5 to the bottom wall thereof, and a tapping hole 6 to the upper wall thereof. Water is supplied from the water supply opening 5 to the hot-water reservoir tank 3, and hot water of high temperature is supplied from the tapping hole 6. Further, in the hot-water reservoir tank 3, there are provided a water intake 10 to the bottom wall thereof, and a hot-water inlet 11 to the upper part of the side wall (peripheral wall). The water intake 10 and the hot-water inlet 11 are connected via a circulation path 12. The circulation path 12 is provided with a pump 13 for water circulation and a heat exchange path 14. Further, a channel 8 for water supply is connected to the water supply opening 5.

The heat source unit 2 is provided with a refrigerant circuit R according to the present embodiment. This refrigerant circuit R is so configured as to connect, a compressor 25 for compressing a refrigerant to a pressure higher than the critical pressure, a hydrothermal exchanger (gas cooler) 26 having the heat exchange path 14, a motor-operated expansion valve (decompressing mechanism) 27, and an air heat exchanger (evaporator) 28, in order. That is, the compressor 25 and the gas cooler 26 are connected via a discharge pipe (refrigerant passage) 29, the gas cooler 26 and the motor-operated expansion valve 27 are connected via a refrigerant passage 30, the motor-operated expansion valve 27 and the evaporator 28 are connected via a refrigerant passage 31, and the evaporator 28 and the compressor 25 are connected via a suction pipe (refrigerant passage) 33 having an accumulator 32. As a refrigerant, a natural system refrigerant such as carbon dioxide ($CO_2$) is used. Note that the gas cooler 26 used as a hydrothermal exchanger has a function of cooling a refrigerant of high temperature and high pressure which has been compressed in the compressor 25. Further, to the discharge pipe 29, an HPS 40 used as a pressure protection switch and a pressure sensor 41 are provided.

Further, the refrigerant circuit R is provided with a liquid-gas heat exchanger 34 for cooling the refrigerant of high pressure and high temperature flown out from the gas cooler 26. The liquid-gas heat exchanger 34 has, for example, a double pipe structure which includes a first passage 35 through which the refrigerant flown out from the gas cooler 26 flows, and a second passage 36 through which the refrigerant flown out from the evaporator 28 flows. That is, the first passage 35 forms a part of the refrigerant passage 30, and the second passage 36 forms a part of the suction pipe 33. With this structure, the refrigerant of high pressure and high temperature flowing through the first passage 35 and the refrigerant of low pressure and low temperature flowing through the second passage 36 perform a heat exchange. Then, the refrigerant flown out from the gas cooler 26 is supercooled. Further, the refrigerant before flown into the accumulator 32 is heated. As such, a wet operation can be prevented.

Further, the refrigerant circuit R is provided with a defrost bypass circuit 38 for connecting the discharge pipe 29 and the refrigerant passage 31. The defrost bypass circuit 38, having a defrost valve 39, is used to perform a defrost operation for supplying hot gas discharged from the compressor 25 to the evaporator 28 so as to remove frost on the evaporator 28. For this purpose, the heat source unit 2 is provided with a defrost control device (not shown) which switches between the normal water heating operation and the defrost operation. In a case that the water heating operation is performed as a normal operation, the gas cooler 26 works as a condenser so as to heat hot water flowing through the heat exchange path 14. On the other hand, in a case that the defrost operation is performed, the motor-operated expansion valve 27 is set to a predetermined opening and the defrost valve 39 is set to be in the opening state, whereby hot gas flows into the evaporator 28. Then, the evaporator 28 is heated by the hot gas, so that frost on the evaporator 28 is removed. Note that the defrost control device is formed of a microcomputer, for example.

Further, the refrigerant circuit R is branched at the high-pressure side, and is provided with a bypass circuit 42 for connecting the branch portion and the downstream portion located downstream of the branch portion. The bypass circuit 42 has a receiver 43. In between the receiver 43 and the downstream portion in the bypass circuit 42, there is provided a adjusting valve 44 for adjusting flow rate. In other words, the bypass circuit 42 includes, a first passage 45 connecting the upstream portion of the gas cooler 26 and the receiver 43, and a second passage 46 connecting the downstream portion located downstream of the upstream portion of the gas cooler 26 and the receiver 43, and the second passage 46 is provided with the adjusting valve 44.

Figure 4:
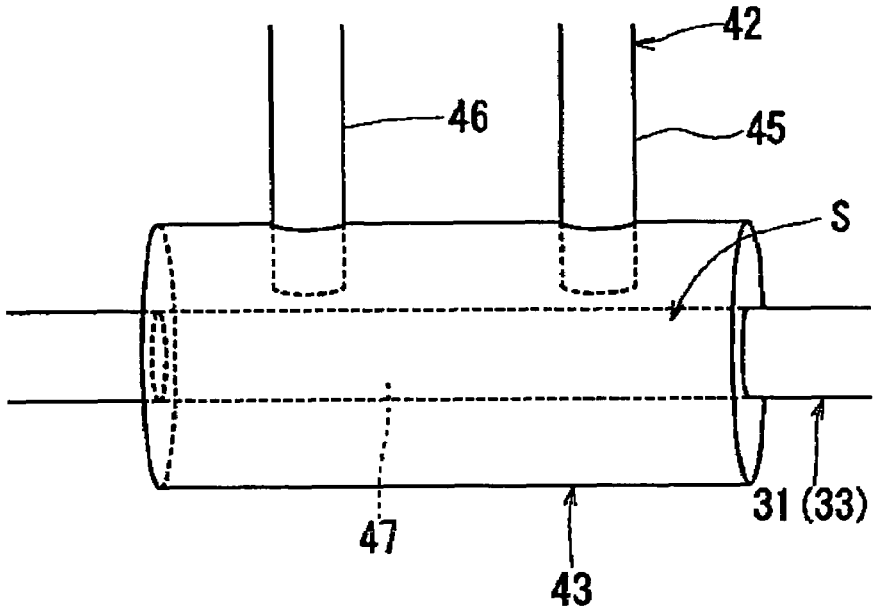
FIG. 4 is a schematic diagram showing a receiver of the refrigerant circuit according to the embodiment.

In the receiver 43, there is provided a passage 47 which forms a part of the refrigerant passage 31, as shown in FIG. 4. The receiver 43 (the high-pressure refrigerant flown into the receiver 43 via the bypass circuit 42) and the low-pressure refrigerant flowing through the passage 47 perform a heat exchange. That is, the low-pressure refrigerant flowing through the passage 47 constitutes a cooler (heat exchanger) S for bringing the temperature of the receiver 43 (high-pressure refrigerant in the receiver 43) close to the target receiver temperature which will be described below.

The target receiver temperature is, for example, determined corresponding to the season. When the temperature of the receiver 43 comes close to the target receiver temperature, the equipment can be operated with the optimum amount of the circulated refrigerant, so that an excessive superheat operation and a wet operation can be prevented. The target receiver temperature is determined corresponding to the season by performing a preliminary test or the like beforehand using the heat pump type hot-water supply equipment.

Figure 2:
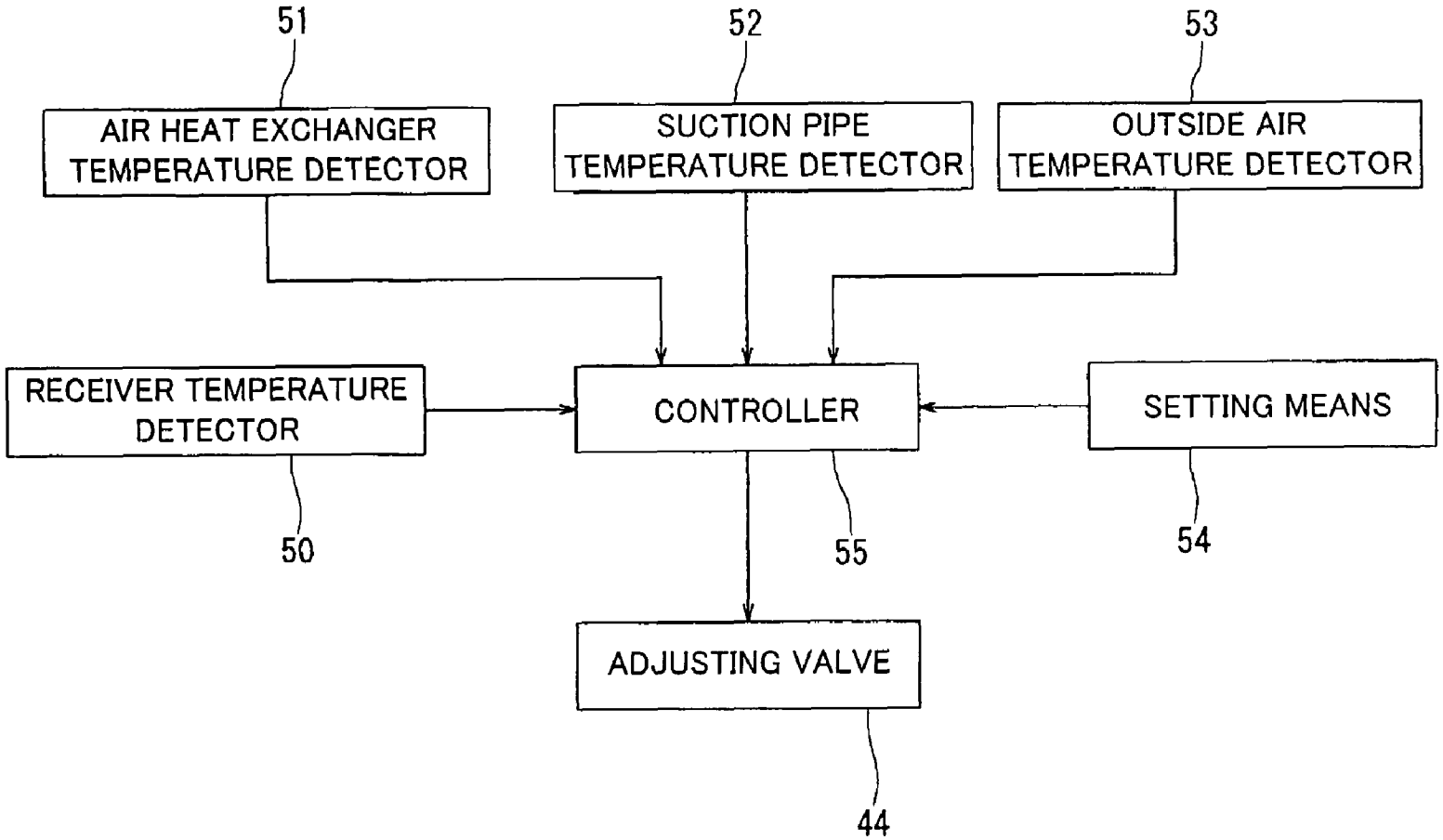
FIG. 2 is a schematic block diagram showing a control unit of a refrigerant circuit according to the embodiment.

As shown in FIG. 2, the control unit of the heat pump type hot-water supply equipment includes, a receiver temperature detector 50, an air heat exchanger temperature detector 51, a suction pipe temperature detector 52, an outside air temperature detector 53, setting means 54 for setting the target receiver temperature, and a controller 55 into which data (value) from each of the detectors 50, 51, 52, 53 and the setting means 54 is input.

The controller 55 adjusts the opening of the adjusting valve 44. By adjusting the opening of the adjusting valve 44 so as to bring the temperature of the receiver 43 close to the target receiver temperature, the controller 55 controls (adjusts) the amount of the refrigerant stored in the receiver 43 (the amount of the refrigerant flowing through the inside of the receiver 43). Thereby, the refrigerant temperature in the receiver 43 is controlled (adjusted). That is, the refrigerant temperature in the receiver 43 is made to the expected temperature (target receiver temperature) by adjusting the opening of the adjusting valve 44 to thereby control the density of the refrigerant in the receiver 43. This can bring the refrigerant amount stored in the receiver 43 to the proper amount. As a result, the amount of the circulated refrigerant can be made to be optimum. Note that the controller 55 is formed of, for example, a microcomputer.

As shown in FIG. 1, in the present embodiment, the receiver temperature detector 50 consists of a receiver thermistor 50*a* provided to the receiver 43, the air heat exchanger temperature detector 51 consists of an air heat exchange thermistor 51*a* provided to the evaporator 28, the suction pipe temperature detector 52 consists of a suction pipe thermistor 52*a* provided to the suction pipe 33, and the outside air temperature detector 53 consists of an outside air thermistor 53*a*. The discharge pipe 29 is also provided with a discharge pipe thermistor 56*a* for detecting the temperature of the discharge pipe.

Next, the driving operation of the heat pump type hot-water supply equipment (water heating operation) will be described.

First, the compressor is driven while the pump 13 for water circulation is also driven (operated). Then, stored water (hot water) flows out from the water intake 10 provided to the bottom of the hot-water reservoir tank 3. Then, the hot water flown out flows through the heat exchange path 14 of the circulation path 12. At this time, the hot water is heated (boiled) by the hydrothermal exchanger 26 which is a gas cooler. The heated hot water flows into the upper part of the hot-water reservoir tank 3 from the hot water inlet 11. By continuing this operation, hot water is stored in the hot-water reservoir tank 3.

It should be noted that under the current Japanese electricity rate system, the electricity rate of the night time is lower than that of the day time. Therefore, in order to reduce the cost, it is preferable that the heat pump type hot-water supply equipment is operated in the midnight time zone.

Figure 3:
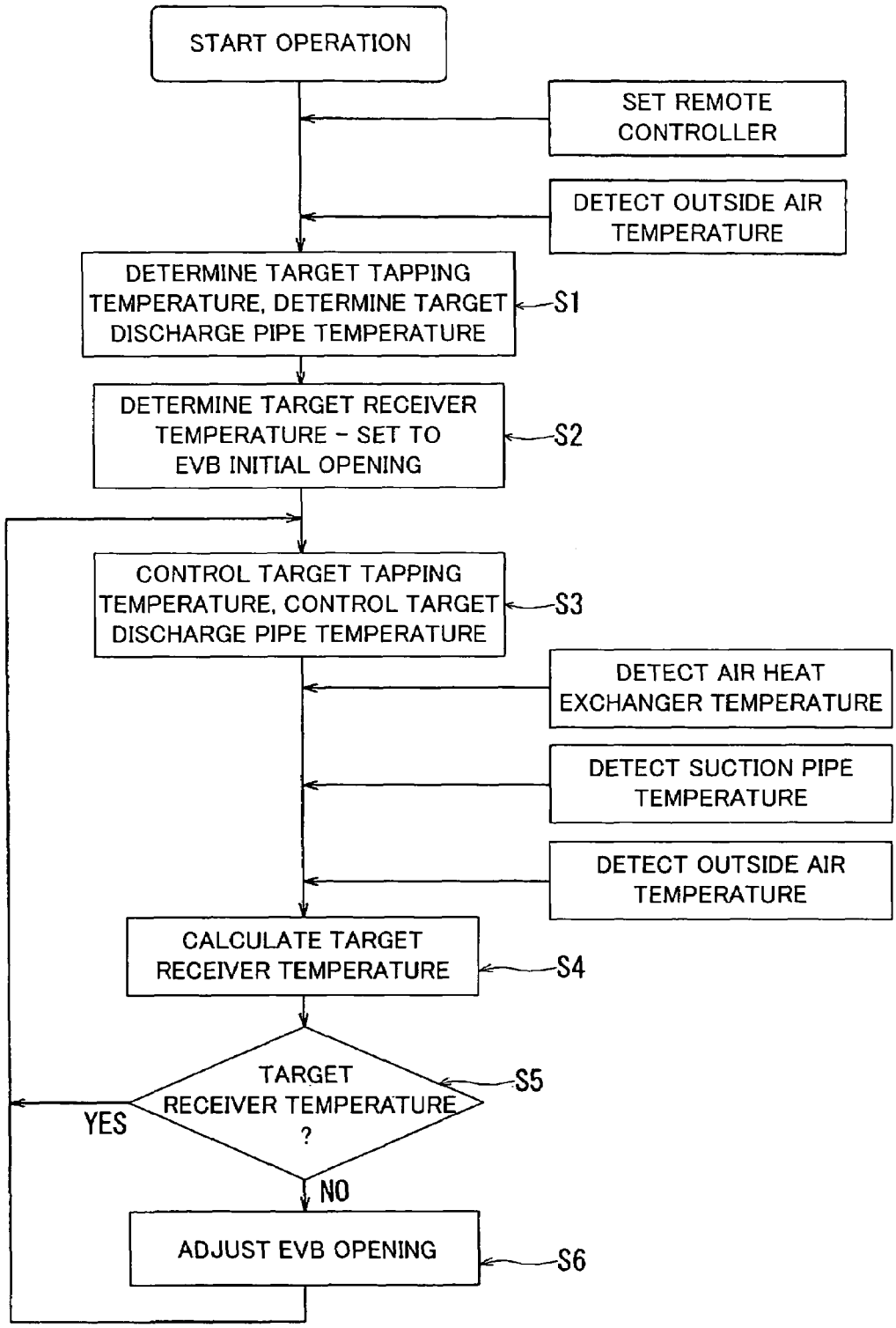
FIG. 3 is a flowchart showing operating processes of the refrigerant circuit according to the embodiment.

Further, the water heating operation of the heat pump type hot-water supply equipment is performed according to the flowchart shown in FIG. 3.

First, a user sets, for example, the tapping temperature by using a remote controller. Further, the outside air thermistor 53*a* detects the outside air temperature, and the temperature (data) detected is input into the controller 55.

Next, as shown as step S1, the target tapping temperature is determined (set) and the target temperature of the discharge pipe is determined (set).

Here, the required amount of the circulated refrigerant differs depending on the season, that is, depending on the outside air temperature. As such, in order to operate with the optimum amount of the circulated refrigerant, the target receiver temperature is determined (set) beforehand based on the outside air temperature detected and the past data (data obtained by the preliminary test or the like), and based on the target receiver temperature determined, the opening (initial opening) of the adjusting valve 44 is set, as shown as step S2.

Next, as shown as step S3, the target tapping temperature is controlled and the target temperature of the discharge pipe is controlled. The control of the target tapping temperature means that the tapping temperature is set to the target tapping temperature. The control of the target temperature of the discharge pipe means that the opening of the motor-operated expansion valve 27 is adjusted (controlled) to thereby set the temperature of the discharge pipe 29 to the target temperature of the discharge pipe.

Further, during operation, the receiver thermistor 50*a*, the air heat exchange thermistor 51*a*, the suction pipe thermistor 52*a*, and the outside air thermistor 53*a* detect the temperature of the receiver 43, the temperature of the air heat exchanger, the temperature of the suction pipe, and the outside air temperature, and then the detected temperatures (data) are input into the controller 55.

Here, when the outside air temperature becomes higher, it is required to increase the amount of the circulated refrigerant, that is, to reduce the amount of the refrigerant stored in the receiver 43. In order to reduce the refrigerant amount stored in the receiver 43, the density of the refrigerant in the receiver 43 should be lowered, and in order to lower the density of the refrigerant in the receiver 43, the temperature of the receiver 43 should be raised. As such, in order to operate the equipment with the optimum amount of the circulated refrigerant when the outside air temperature becomes higher, the temperature of the receiver 43 should be raised. In turn, when the outside air temperature becomes lower, the temperature of the receiver 43 should be lowered.

Further, when the superheat degree of the refrigerant at the outlet of the evaporator 28 becomes larger, it is required to increase the amount of the circulated refrigerant, that is, to reduce the amount of the refrigerant stored in the receiver 43. Therefore, as same as the aforementioned, in order to operate the equipment with the optimum amount of the circulated refrigerant when the superheat degree becomes larger, the temperature of the receiver 43 should be raised. In turn, when the superheat degree becomes smaller, the temperature of the receiver 43 should be lowered.

Now, the controller 55 computes the superheat degree of the refrigerant at the outlet of the evaporator 28 based on the detected air heat exchanger temperature and the suction pipe temperature, and calculates the target receiver temperature based on the detected outside air temperature, the calculated superheat degree and the past data. Then, the controller 55 judges whether the target receiver temperature calculated coincides with the target receiver temperature having been set beforehand. If judges that the target receiver temperature calculated is different from the target receiver temperature set beforehand, the controller 55 corrects the target receiver temperature to the target receiver temperature which is calculated from the target receiver temperature set beforehand ("calculates the target receiver temperature" shown as step S4). This means that the optimum amount of the circulated refrigerant for the current operational state may not be obtained at the target receiver temperature set in step S2 in some cases, since the condensation load and the cooling load have been fluctuated. Therefore, in this step S4, the target receiver temperature, with which the amount of the circulated refrigerant is made to be optimum, is calculated.

Next, moving to step S5, the controller 55 compares the detected temperature of the receiver 43 with the target receiver temperature corrected. That is, in step S5, the detected temperature of the receiver 43 and the target receiver temperature (the target receiver temperature which has been corrected) are judged whether they coincide with each other.

If the detected temperature of the receiver 43 and the target receiver temperature corrected are judged that they coincide with each other, the operation for controlling the target tapping temperature and the operation for controlling the target temperature of the discharge pipe are continued (step S3).

In contrast, if the detected temperature of the receiver 43 and the target receiver temperature corrected are judged to be different, the operation moves to step S6. Then, the controller 55 performs an EVB opening adjustment (opening adjustment of the adjusting valve 44) so as to adjust the refrigerant amount stored in the receiver 43. If the detected temperature of the receiver 43 is higher than the target receiver temperature corrected, the adjusting valve 44 is choked. If the detected temperature of the receiver 43 is lower than the target receiver temperature corrected, the adjusting valve 44 is released. With this step, the temperature of the receiver 43 can come close to the target receiver temperature corrected so that the amount of the circulated refrigerant can be made to the expected amount corresponding to the current operational state (operational condition).

For example, the optimum amount of the circulated refrigerant in the summer (the outside air temperature is about 32° C.) is larger than the optimum amount of the circulated refrigerant in the winter (outside air temperature is about −5° C.). Therefore, in the winter, the temperature of the receiver 43 is controlled so as to come close to the target receiver temperature of the winter, to thereby store in the receiver 43 the amount of the refrigerant corresponding to the difference between the optimum amount of the circulated refrigerant for the summer and the optimum amount of the circulated refrigerant for the winter. Thereby, the amount of the circulated refrigerant in the winter becomes less than the amount of the circulated refrigerant in the summer. On the other hand, in the summer, the temperature of the receiver 43 is controlled so as to come close to the target receiver temperature of the summer, to thereby cause the amount of the refrigerant stored in the receiver 43 during the winter to flow out. Thereby, the amount of the circulated refrigerant in the summer becomes larger than the optimum amount of the circulated refrigerant in the winter.

Figure 6:
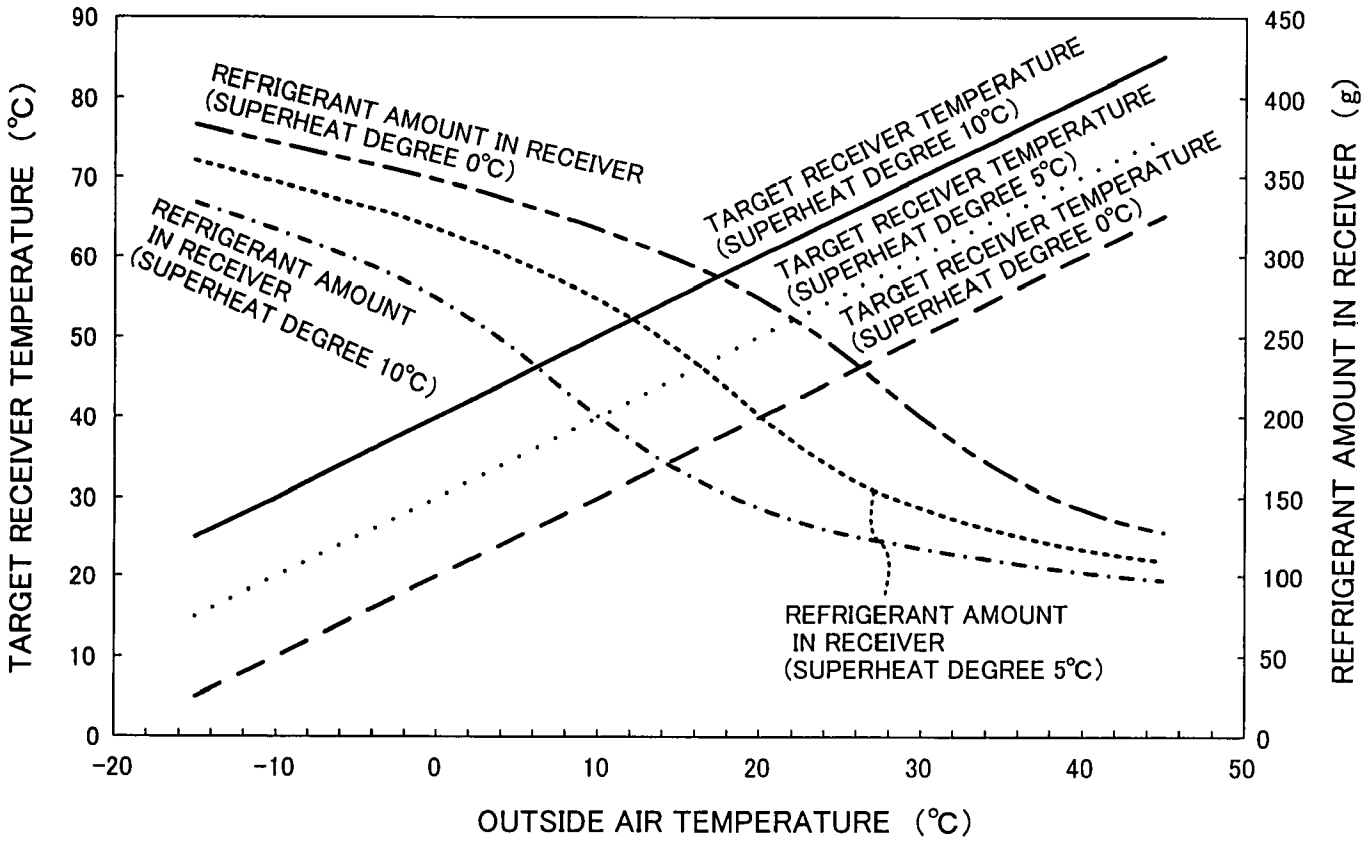
FIG. 6 is a diagram showing the relationship among outside air temperatures, superheat degrees of the refrigerant of the outlet of the evaporator, target receiver temperatures, and the amount of refrigerant stored in the receiver.
Figure 7:
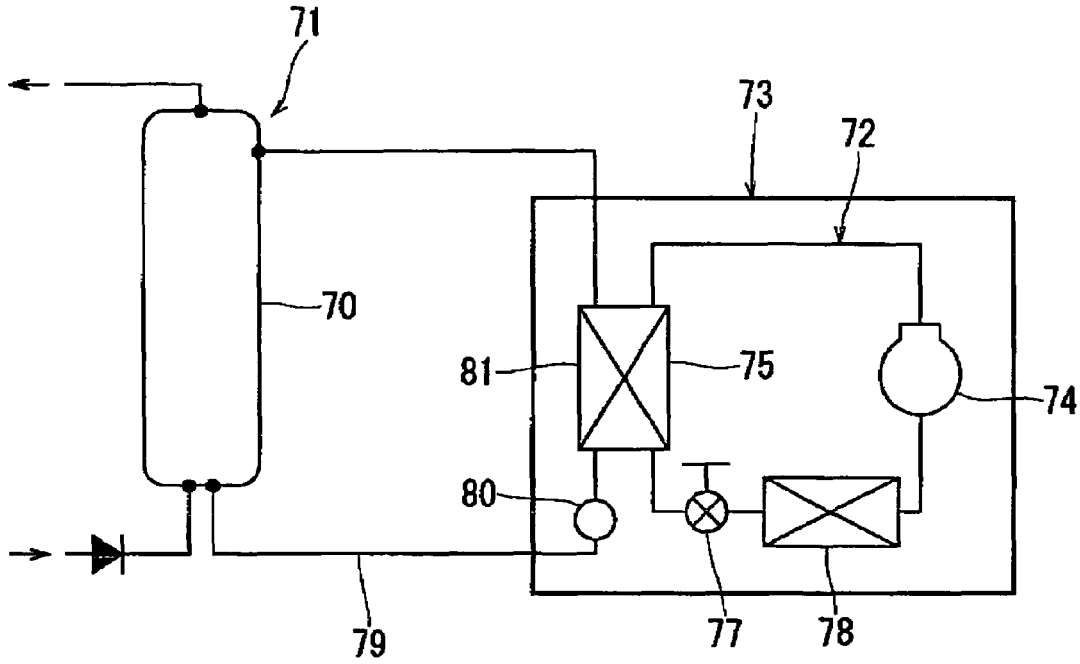
FIG. 7 is a schematic diagram showing conventional heat pump type hot-water supply equipment.

FIG. 6 shows the relationship among the outside air temperature, the superheat degree of the refrigerant at the outlet of the evaporator 28, the target receiver temperature, and the refrigerant amount stored in the receiver 43 (the amount of the refrigerant flowing through the inside of the receiver 43), which are obtained from experimentations using the heat pump type hot-water supply equipment according to the present embodiment. The heat pump type hot-water supply equipment used in the experimentations includes the receiver 43 with the capacity of 400 cc and the pressure inside the receiver 43 is 11 Mpa.

As is obvious in FIG. 6, when the outside air temperature becomes higher, the target receiver temperature becomes higher. This is because that as the outside air temperature becomes higher, the amount of the circulated refrigerant must be increased, that is, the refrigerant amount in the receiver 43 must be reduced. In order to reduce the refrigerant amount in the receiver 43, the target receiver temperature must be raised. As such, the target receiver temperature becomes higher as the outside air temperature becomes higher.

Further, as is obvious in FIG. 6, as the superheat degree becomes larger, the target receiver temperature becomes higher. This is because that as the superheat degree becomes larger, the amount of the circulated refrigerant must be increased, that is, the refrigerant amount in the receiver 43 must be reduced. In order to reduce the refrigerant amount in the receiver 43, the target receiver temperature must be raised. As such, the target receiver temperature becomes higher as the superheat degree becomes larger. By raising the target receiver temperature, the superheat degree becomes smaller.

In this way, the equipment can be operated with the amount of the circulated refrigerant corresponding to the season (condition) regardless of the fluctuation in the outside air temperature along with the season's transfer. Thereby, an excessive superheat operation and a wet operation can be prevented. Consequently, the reliability of the compressor 25 is improved. Further, by controlling the amount of the circulated refrigerant as described above, the heat pump type hot-water supply equipment having the refrigerant circuit R can exhibit the ability to the maximum.

Further, the controller 55 can adjust the refrigerant temperature in the receiver 43 by controlling the temperature of the receiver 43 so as to come close to the target receiver temperature set corresponding to, for example, the season. Thereby, the density of the refrigerant stored in the receiver 43 can be controlled, so that the refrigerant amount stored in the receiver 43 can be adjusted. Thus, the refrigerant amount stored in the receiver 43 can be adjusted to the amount corresponding to the season, so that the amount of the circulated refrigerant is made to the amount corresponding to the season. Therefore, an excessive superheat operation and a wet operation can be prevented.

Further, the controller 55 calculates the target receiver temperature based on the outside air temperature and the superheat degree serving as indexes for controlling the amount of the circulated refrigerant. Therefore, it is possible to ensure the amount of the circulated refrigerant to be the expected amount (for example, amount of the circulated refrigerant corresponding to the season).

Further, in step S4, the target receiver temperature is corrected based on two indexes which are the outside air temperature and the superheat degree. Therefore, it is possible to control the amount of the circulated refrigerant with higher precision.

Further, the controller 55 brings the temperature of the receiver 43 close to the target receiver temperature by adjusting the opening of the adjusting valve 44. Therefore, the amount of the circulated refrigerant can be controlled by such a simple control as adjusting the opening of the adjusting valve 44.

Further, the controller 55 corrects, from time to time during operation, the target receiver temperature based on the outside air temperature and the superheat degree, while adjusting, from time to time during operation, the adjusting valve 44 to be the opening corresponding to the target receiver temperature adjusted. Thus, the temperature of the receiver 43 can surely come close to the target receiver temperature corrected. Thereby, the refrigerant amount stored in the receiver 43 can be made to the amount corresponding to, for example, the season, so that the amount of the circulated refrigerant can be made to the amount corresponding to the season. This can prevent an excessive superheat operation and a wet operation.

Further, since the adjusting valve 44 is provided to the second passage 46 of the bypass circuit 42, the controller 55 can surely control the refrigerant amount stored in the receiver 43 provided to the bypass circuit 42 by adjusting the opening of the adjusting valve 44. Therefore, the amount of the circulated refrigerant is ensured to be the expected amount.

Further, since the receiver 43 and the low-pressure refrigerant flowing through the passage 47 perform a heat exchange, the receiver 43 can be cooled by the low-pressure refrigerant. Therefore, the temperature of the receiver 43 can easily come close to the target receiver temperature without any additional cooler.

Although the aforementioned embodiment sets a target receiver temperature and then corrects the target receiver temperature based on the detected outside air temperature and the computed superheat degree, the target receiver temperature may be corrected (calculated) based solely on the outside air temperature or the superheat degree. Here, since the outside air temperature is detected by the outside air thermistor 53*a*, the outside air temperature can be detected without a calculation. Therefore, if the target receiver temperature is calculated based on the outside air temperature, it is possible to simplify the calculation for controlling the amount of the circulated refrigerant. Further, the magnitude of the superheat degree has a close relationship with the degree of the superheat operation. Therefore, if the target receiver temperature is calculated based on the superheat degree, the amount of the circulated refrigerant can be controlled with high precision.

Further, although the aforementioned embodiment shows processes from step S1 to step S6 in the flowchart of FIG. 3, step S4 and step S5 may be omitted. That is, the superheat degree may be calculated based on the temperature of the air heat exchanger and the temperature of the suction pipe, and based on the detected outside air temperature and the calculated superheat degree, the opening of the adjusting valve 44 may be determined. This enables to adjust the refrigerant amount stored in the receiver 43, whereby the amount of the circulated refrigerant can be made to the expected amount corresponding to the operational state. At this time, it is not required to calculate (correct) the target receiver temperature, to compare the temperature of the receiver 43 with the calculated (corrected) target receiver temperature, and the like, which enable to simplify the control of the amount of the circulated refrigerant. Further, in the case of omitting step S4 and step S5, the opening of the adjusting valve 44 can be determined based on at least one of the outside air temperature or the superheat degree.

Further, the receiver 43 may be configured in such a manner as to cause the high-pressure refrigerant to flow and to cause the receiver 43 (the high-pressure refrigerant flown) and the low-pressure refrigerant to perform a heat exchange. Therefore, the first passage 45 of the bypass circuit 42 may be branched from the discharge pipe 29, the gas cooler 26 or the refrigerant passage 30, and the second passage 46 may be connected to the discharge pipe 29, the gas cooler 26 or the refrigerant passage 30 which are located downstream of the aforementioned branch portion. That is, the first passage 45 and the second passage 46 may be provided to the upstream side of the decompressing mechanism (motor-operated expansion valve) 27 in the high-pressure side of the refrigerant circuit R. However, the first passage 45 and the second passage 46 must be so formed as to generate a pressure difference between the first passage 45 and the second passage 46.

Figure 5:
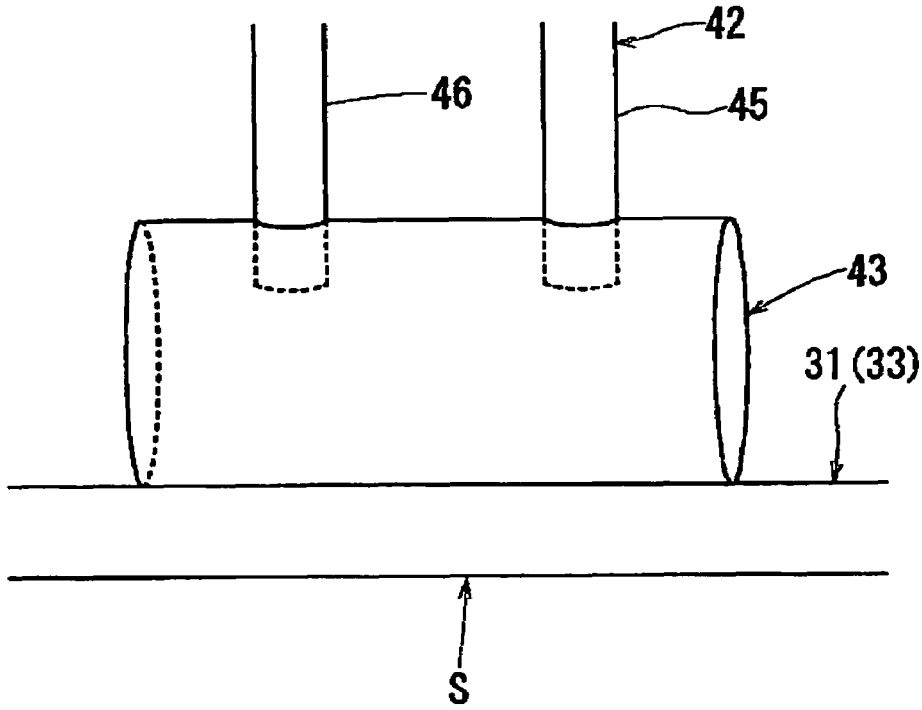
FIG. 5 is a schematic diagram showing a deformation example of the receiver of the refrigerant circuit according to the embodiment.

Further, the low-pressure refrigerant performing a heat exchange with the receiver 43 may be the low-pressure refrigerant flowing through the suction pipe 33. Moreover, in order to perform the heat exchange, the passages for the low-pressure refrigerant such as the refrigerant passage 31 and the suction pipe 33 may be formed along the outer surface of the receiver 43 as shown in FIG. 5. Moreover, the passages for the low-pressure refrigerant may be coiled to the outer peripheral of the receiver 43, although this is not shown.

As described above, although a specific embodiment of the present invention has been explained, this invention is not limited to the aforementioned embodiment and is able to be carried out with various changes within the scope of the invention. For example, the refrigerant circuit R can be applied to a refrigerant circuit of any type of refrigerating apparatus such as an air conditioning apparatus or a showcase, other than heat-pump type hot-water supply equipment. Further, as a refrigerant, a natural system refrigerant (supercritical refrigerant) other than carbon dioxide, such as ethylene, ethane or nitrogen oxide, may be used. Further, as a cooler S for cooling the receiver 43 (high-pressure refrigerant in the receiver 43), a fan device or other cooling devices may be used instead of using a low-pressure refrigerant, and moreover, a part of the evaporator 28 may also be used. Further, as the adjusting valve 44, not only a motor-operated valve but also a solenoid valve or other open/close valves may be used. Further, as the decompressing mechanism 27, not only a motor-operated expansion valve but also a capillary tube may be used. Further, the receiver 43 and the heat exchanger (liquid-gas heat exchanger) 34 shown in FIG. 1 may be arranged in reverse order.

INDUSTRIAL APPLICABILITY

As described above, the refrigerating apparatus according to the present invention is available for a heat source unit of heat-pump type hot-water supply equipment.

The invention claimed is:

1. A refrigerating apparatus comprising:

a supercritical freezing cycle having a compressor for compressing a refrigerant to a pressure higher than a critical pressure, a gas cooler, a decompressing mechanism and an evaporator, and using as the refrigerant a natural system refrigerant;

a receiver provided to a high-pressure side of the supercritical freezing cycle;

a receiver temperature detector for detecting a temperature of the receiver;

a bypass circuit for connecting an intermediate portion in the high-pressure side of the supercritical freezing cycle and a downstream portion located at a downstream side of the intermediate portion, wherein the receiver is provided to the bypass circuit, an adjusting valve provided in between the receiver and the downstream portion in the bypass circuit for adjusting an amount of the refrigerant flowing through an inside of the receiver, and a controller for controlling a density of a circulated liquid refrigerant flowing through the inside of the receiver by bringing the temperature of the receiver detected by the receiver temperature detector close to a target receiver temperature, wherein the target receiver temperature is determined based on data obtained by a preliminary test.

2. The refrigerating apparatus as claimed in claim 1, further comprising an outside air temperature detector for detecting an outside air temperature, wherein the controller is so configured as to calculate the target receiver temperature based on the outside air temperature detected by the outside air temperature detector.

3. The refrigerating apparatus as claimed in claim 1, further comprising a superheat degree detector for detecting a superheat degree of the refrigerant at an outlet of the evaporator, wherein the controller is so configured as to calculate the target receiver temperature based on the superheat degree detected by the superheat degree detector.

4. The refrigerating apparatus as claimed in claim 1, further comprising:

an outside air temperature detector for detecting an outside air temperature; and a superheat degree detector for detecting a superheat degree of the refrigerant at an outlet of the evaporator, wherein the controller is so configured as to calculate the target receiver temperature based on the outside air temperature detected by the outside air temperature detector and the superheat degree detected by the superheat degree detector.

5. The refrigerating apparatus as claimed in claim 1, wherein the controller is so configured as to adjust an opening of the adjusting valve to thereby bring the temperature of the receiver detected by the receiver temperature detector close to the target receiver temperature.

6. The refrigerating apparatus as claimed in claim 1, further comprising, an adjusting valve for adjusting an amount of the refrigerant flowing through an inside of the receiver, and an outside air temperature detector detecting an outside air temperature, wherein the controller is so configured as to correct, from time to time during operation, the target receiver temperature based on the outside air temperature, and adjust, from time to time during operation, an opening of the adjusting valve, to thereby bring the temperature of the receiver close to the target receiver temperature corrected.

7. The refrigerating apparatus as claimed in claim 1, further comprising, an adjusting valve for adjusting an amount of the refrigerant flowing through an inside of the receiver, and a superheat degree detector for detecting a superheat degree of the refrigerant at an outlet of the evaporator, wherein the controller is so configured as to correct, from time to time during operation, the target receiver temperature based on the superheat degree, and adjust, from time to time during operation, an opening of the adjusting valve, to thereby bring the temperature of the receiver close to the target receiver temperature corrected.

8. The refrigerating apparatus as claimed in claim 1, farther comprising, an adjusting valve for adjusting an amount of the refrigerant flowing through an inside of the receiver, an outside air temperature detector detecting an outside air temperature, and a superheat degree detector for detecting a superheat degree of the refrigerant at an outlet of the evaporator, wherein the controller is so configured as to correct, from time to time during operation, the target receiver temperature based on the outside air temperature and the superheat degree, and adjust, from time to time during operation, an opening of the adjusting valve, to thereby bring the temperature of the receiver close to the target receiver temperature corrected.

9. The refrigerating apparatus as claimed in claim 1, further comprising a heat exchanger for causing a heat exchange between the receiver and a low-pressure refrigerant flowing through a passage in a low-pressure side of the supercritical freezing cycle.

10. A refrigerating apparatus comprising:

a supercritical freezing cycle having a compressor for compressing a refrigerant to a pressure higher than a critical pressure, a gas cooler, a decompressing mechanism and an evaporator, and using as the refrigerant a natural system refrigerant;

a receiver provided to a high-pressure side of the supercritical freezing cycle;

an adjusting valve for adjusting an amount of the refrigerant flowing through an inside of the receiver;

an outside air temperature detector for detecting an outside air temperature;

a bypass circuit for connecting an intermediate portion in the high-pressure side of the supercritical freezing cycle and a downstream portion located at a downstream side of the intermediate portion, wherein the receiver is provided to the bypass circuit, and the adjusting valve is provided in between the receiver and the downstream portion in the bypass circuit; and a controller for controlling a density of a circulated liquid refrigerant flowing through the inside of the receiver by adjusting an opening of the adjusting valve based on the outside air temperature detected by the outside air temperature detector and data obtained by a preliminary test.

11. The refrigerating apparatus as claimed in claim 10, further comprising a heat exchanger for causing a heat exchange between the receiver and a low-pressure refrigerant flowing through a passage in a low-pressure side of the supercritical freezing cycle.

12. A refrigerating apparatus comprising:

a supercritical freezing cycle having a compressor for compressing a refrigerant to a pressure higher than a critical pressure, a gas cooler, a decompressing mechanism and an evaporator, and using as the refrigerant a natural system refrigerant;

a receiver provided to a high-pressure side of the supercritical freezing cycle;

an adjusting valve for adjusting an amount of the refrigerant flowing through an inside of the receiver;

a superheat degree detector for detecting a superheat degree of the refrigerant at an outlet of the evaporator;

a bypass circuit for connecting an intermediate portion in the high-pressure side of the supercritical freezing cycle and a downstream portion located at a downstream side of the intermediate portion, wherein the receiver is provided to the bypass circuit, and the adjusting valve is provided in between the receiver and the downstream portion in the bypass circuit; and a controller for controlling a density of a circulated liquid refrigerant flowing through the inside of the receiver by adjusting an opening of the adjusting valve based on the superheat degree detected by the superheat degree detector and data obtained by a preliminary test.

13. The refrigerating apparatus as claimed in claim 12, further comprising a heat exchanger for causing a heat exchange between the receiver and a low-pressure refrigerant flowing through a passage in a low-pressure side of the supercritical freezing cycle.

14. A refrigerating apparatus comprising:

a supercritical freezing cycle having a compressor for compressing a refrigerant to a pressure higher than a critical pressure, a gas cooler, a decompressing mechanism and an evaporator, and using as the refrigerant a natural system refrigerant;

a receiver provided to a high-pressure side of the supercritical freezing cycle;

an adjusting valve for adjusting an amount of the refrigerant flowing through an inside of the receiver;

an outside air temperature detector for detecting an outside air temperature;

a superheat degree detector for detecting a superheat degree of the refrigerant at an outlet of the evaporator a bypass circuit for connecting an intermediate portion in the high-pressure side of the supercritical freezing cycle and a downstream portion located at a downstream side of the intermediate portion, wherein the receiver is provided to the bypass circuit, and the adjusting valve is provided in between the receiver and the downstream portion in the bypass circuit; and a controller for controlling a density of a circulated liquid refrigerant flowing through the inside of the receiver by adjusting an opening of the adjusting valve based on the outside air temperature detected by the outside air temperature detector, the superheat degree detected by the superheat degree detector, and data obtained by a preliminary test.

15. The refrigerating apparatus as claimed in claim 14, further comprising a heat exchanger for causing a heat exchange between the receiver and a low-pressure refrigerant flowing through a passage in a low-pressure side of the supercritical freezing cycle.

* * * * *

UNITED STATES PATENT AND TRADEMARK OFFICE

CERTIFICATE OF CORRECTION

PATENT NO. : 7,481,067 B2
APPLICATION NO. : 10/492369
DATED : January 27, 2009
INVENTOR(S) : Hiroshi Nakayama et al.

It is certified that error appears in the above-identified patent and that said Letters Patent is hereby corrected as shown below:

Title Page, item (54) Title:

The line reading "FREEZER" should read --REFRIGERATING APPARATUS--.

Title Page, item (56) References Cited:

The following references should be listed:

--5,987,907 A 11/1999 Morimoto et al.--;

--4,831,835 A 05/1989 Beehler et al.--;

--6,250,099 B1 06/2001 Furuya et al.--; and

--JP 2005-015633 A 01/2005--.

Signed and Sealed this

Seventh Day of April, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,481,067 B2
APPLICATION NO. : 10/492369
DATED : January 27, 2009
INVENTOR(S) : Hiroshi Nakayama et al.

It is certified that error appears in the above-identified patent and that said Letters Patent is hereby corrected as shown below:

Title Page, item (54) and Column 1, line 1, Title:

The line reading "FREEZER" should read --REFRIGERATING APPARATUS--.

Title Page, item (56) References Cited:

The following references should be listed:

--5,987,907 A 11/1999 Morimoto et al.--;

--4,831,835 A 05/1989 Beehler et al.--;

--6,250,099 B1 06/2001 Furuya et al.--; and

--JP 2005-015633 A 01/2005--.

This certificate supersedes the Certificate of Correction issued April 7, 2009.

Signed and Sealed this

Twenty-eighth Day of April, 2009

John Doll

JOHN DOLL
*Acting Director of the United States Patent and Trademark Office*